United States Patent [19]

Pimintel

[11] Patent Number: 4,662,767

[45] Date of Patent: May 5, 1987

[54] ANTI-BACKLASH TRACTOR ASSEMBLY

[75] Inventor: Antone Pimintel, San Leandro, Calif.

[73] Assignee: Xerox Corporation, Stamford, Conn.

[21] Appl. No.: 764,452

[22] Filed: Aug. 12, 1985

[51] Int. Cl.[4] ..... B41J 11/30

[52] U.S. Cl. ..... 400/616.2; 400/604

[58] Field of Search ..... 400/616, 616.1, 616.2, 400/616.3, 636.2, 604, 607.2, 624, 625, 629; 74/409

[56] References Cited

U.S. PATENT DOCUMENTS

| | | | |
|---|---|---|---|
| 2,130,015 | 9/1938 | Jensen | 400/616.2 |
| 4,086,997 | 5/1978 | Wu | 400/57 |
| 4,402,623 | 9/1983 | Biche et al. | 400/618 |
| 4,440,516 | 4/1984 | Rosenthal et al. | 400/616.1 |
| 4,485,950 | 12/1984 | Kuelzer | 400/616.1 X |
| 4,544,294 | 10/1985 | Runzi | 400/636.2 |
| 4,563,101 | 1/1986 | Okamura et al. | 400/636.2 |
| 4,571,103 | 2/1986 | Takeo et al. | 400/616.1 X |

OTHER PUBLICATIONS

IBM Technical Disclosure Bulletin, vol. 26, No. 10A, pp. 4974–4975, Mar. 1984, "Anti-Backlash Index Drive Mechanism", by Krimm et al.

*Primary Examiner*—Charles A. Pearson
*Attorney, Agent, or Firm*—Serge Abend

[57] ABSTRACT

An anti-backlash tractor assembly for the accurate registration of bi-directionally transported endless paper to the printing mechanism of a printer. When mounted upon the printer in an operative position, a resilient biasing device will urge the printer driving gear and the tractor assembly driven gear together for dynamically eliminating backlash therebetween and for dynamically compensating for gear eccentricities and other drive train variations. Also, in the operative position, a manual adjustment lever is provided for establishing nominal paper tension.

6 Claims, 6 Drawing Figures

ANTI-BACKLASH TRACTOR ASSEMBLY

Figure 1:
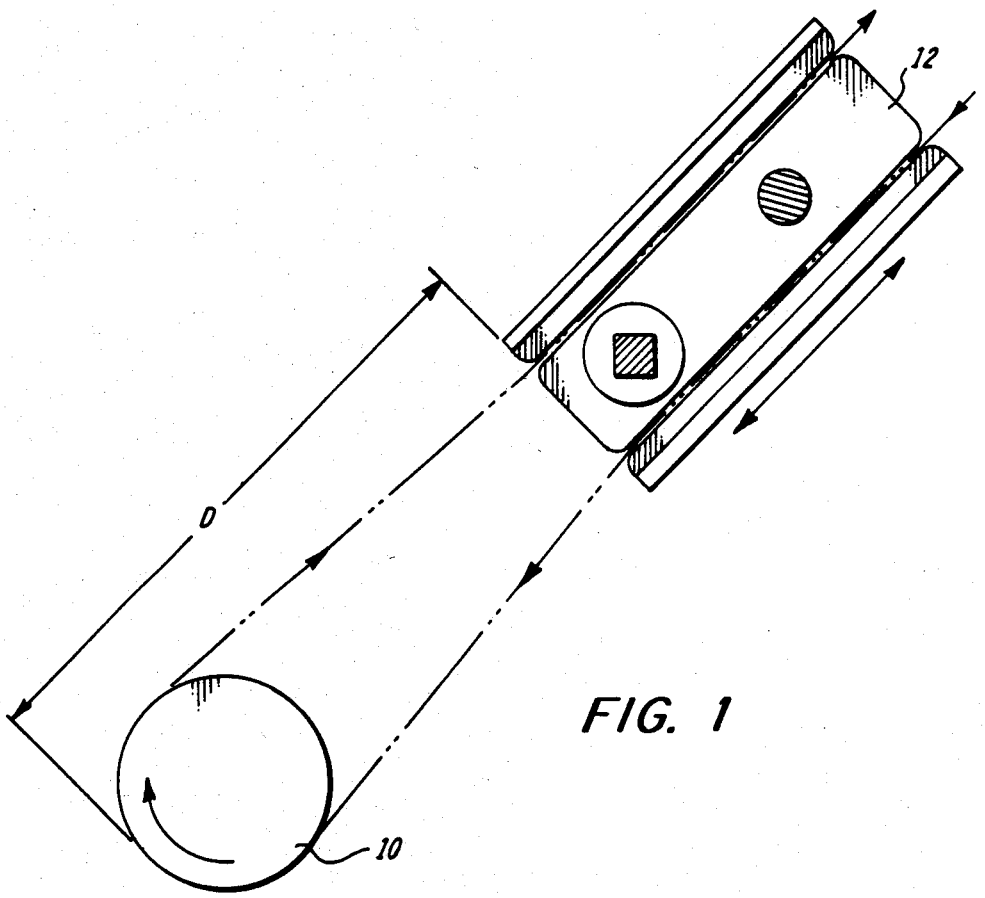

This invention relates to a detachable tractor-type transport device for moving an endless form to and from the printing platen of a data printer. More particularly, this device is provided with means for eliminating misalignment during bi-directional feed thereof.

Tractor transport devices employ a pair of belts having pins extending therefrom for entering the perforated lateral edge transport zones of the known endless forms. Typically, the endless form follows a paper path passing through one side of the tractors, around the platen and through the other side of the tractors. It is commonplace during routine usage that endless forms of different thicknesses are introduced into the printer, for different purposes. For example, the operator may wish to initially load a single thickness endless form, having a nominal thickness of about 0.004 inches, followed by loading a six part form with interleaved carbons, which may have a nominal thickness of 0.027 to 0.030 inches. If such a change is made, there will be a tremendous disparity in the length of the overall paper path. Since the single thickness form will have a longer paper path than the multi-part form, these transitions will result in too much slack in the paper path or too tight a paper path.

If the transport assembly is manufactured with a fixed distance between the tractor and the platen roller an appropriate driving tension on the paper will exist for some forms thicknesses but not for others. Some will probably be too tight whereas some will probably have too much slack. If the problem is the former, it is possible that the tractor sprocket pins will tear through the sprocket holes in the paper, completely impairing paper feed registration. Another possibility is that the driving tension will increase to such a high level as to overload the drive motor and burn it out. Conversely, if there is too much slack, misregistration will surely occur during bi-directional feeding while printing graphic information, where overprinting is essential.

In order for the tractor feed to operate properly the tension in the paper path must be properly controlled. It should be apparent that in order to allow the flexibility of such usage and still retain optimum registration during forward and reverse feeding, as is required in overprinting and graphic printing, some device must be provided to compensate for differences in overall path length.

Additional misregistration during bi-directional feeding will be caused by the usual gear backlash between the printer drive gears and the transport assembly driven gears. Eccentricities in the molded gears also generate backlash. The misregistration problem is made more acute by the fact that the accessory device is removably mounted upon the printer and its design must lend itself to easy mounting on and removal from the printer by an operator. It would be totally unacceptable for the accessory device to be designed so that the operator would have to make registration adjustments.

In U.S. Pat. No. 4,402,623 there is disclosed an apparatus for adjusting the paper tension in a tractor assembly. Adjustment is accomplished by moving the pair of tractors relative to the sheet feeder side frames, and thus relative to the platen, by means of a rack and pinion arrangement. A manually operable lever is used to effect changes in the document tension. No anti-backlash compensation has been provided.

In U.S. Pat. No. 4,440,516 a tractor assembly is provided with adjustment means for varying the paper tension in diverse endless forms, as desired. This is accomplished by a pair of control levers pivotably journalled on each of the assembly side walls and lockable in several pivoted positions. As the adjustment levers are moved, the sidewalls are driven forward and rearward so that the distance between the tractors supported thereby and the platen roller is changed.

It can be seen that in each of these patents the only problem which has been addressed, and a solution arrived at, is the adjustment of the distance between the paper feed tractors and the platen roller in order to compensate for variations in the length of the paper path, caused by different forms thicknesses. Although the patented solutions do provide some relief to misregistration during bi-directional feed they are not suitable for highly accurate registration as they do not take into account gear train backlash inherent in most systems. Furthermore, they are static solutions which do not compensate for inherent eccentricities or variations which cyclicly change the paper tension.

It is therefore an object of the present invention to provide a tractor assembly for a printer wherein, once mounted in place, manual adjustment is provided for setting nominal paper tension, and minor drive train variations are dynamically compensated for by means of a resilent mounting arrangement.

It is a further object of this invention to provide a resilient mounting arrangement which will eliminate backlash from the driving gear train and will dynamically compensate for gear eccentricities and other drive train variations.

The present invention may be carried out, in one form, by providing a transport assembly which may be readily mounted upon a printer for transporting endless form paper to and from a printing mechanism. The printer includes a pair of side walls, a platen mounted upon a support shaft journalled for rotation in the side walls, transport assembly positioning pins extending from each of the side walls and a drive gear supported by one of the side walls. My improved transport assembly comprises a pair of side plates supported in opposed, spaced relationship to one another with a drive shaft supported by the side plates for rotation relative thereto and a pair of tractors driven by the drive shaft. A driven gear coupled to the drive shaft is supported upon one of the side plates for rotating the drive shaft. Adjustment means is provided for varying the distance between the platen support shaft and the tractors, and locking means is provided for locating the transport assembly in an operative position on the printer. Locating means for resiliently biasing the paper driving means against the platen shaft and for resiliently biasing the driven gear against the drive gear when the transport assembly is in its operative position acts to dynamically compensate for variations in the gear train which would adversely affect registration during bi-directional feeding.

Figure 2:
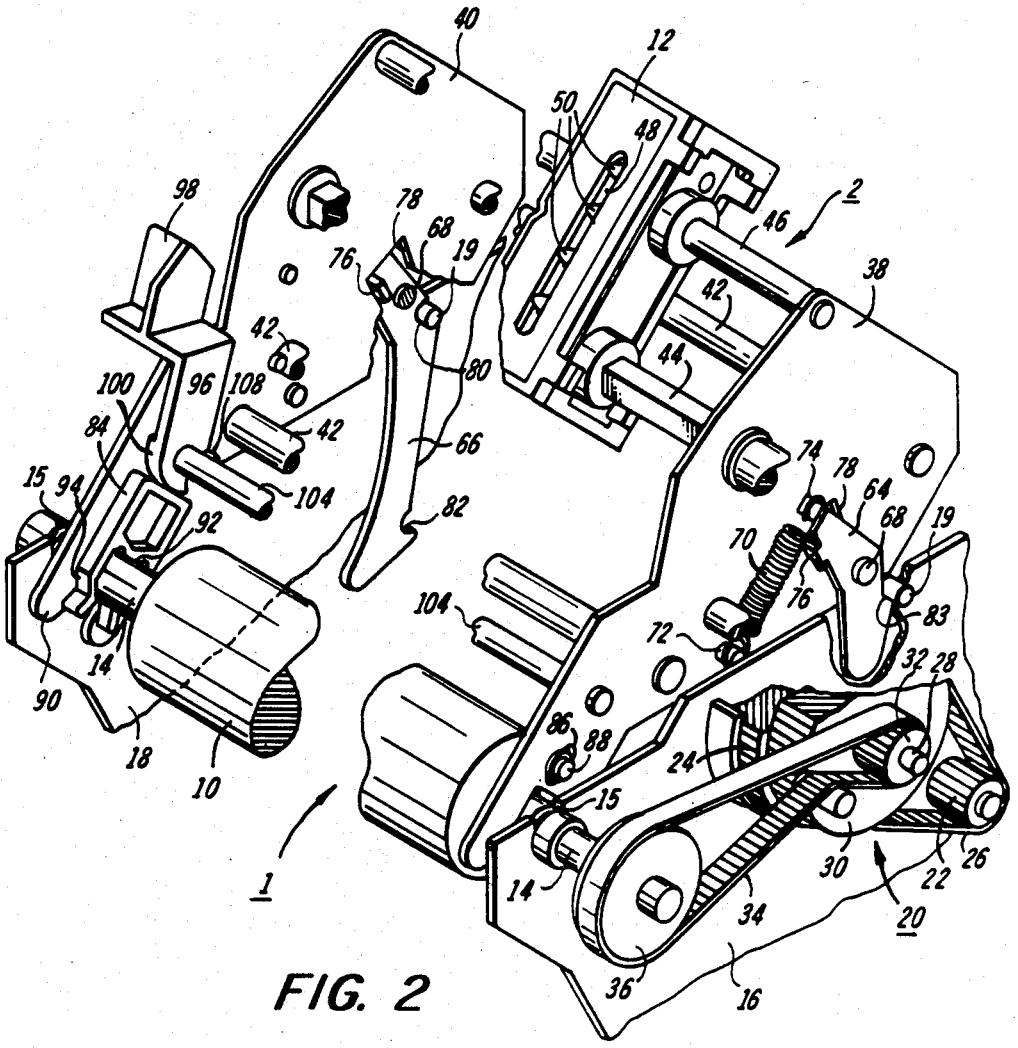
Figure 3:
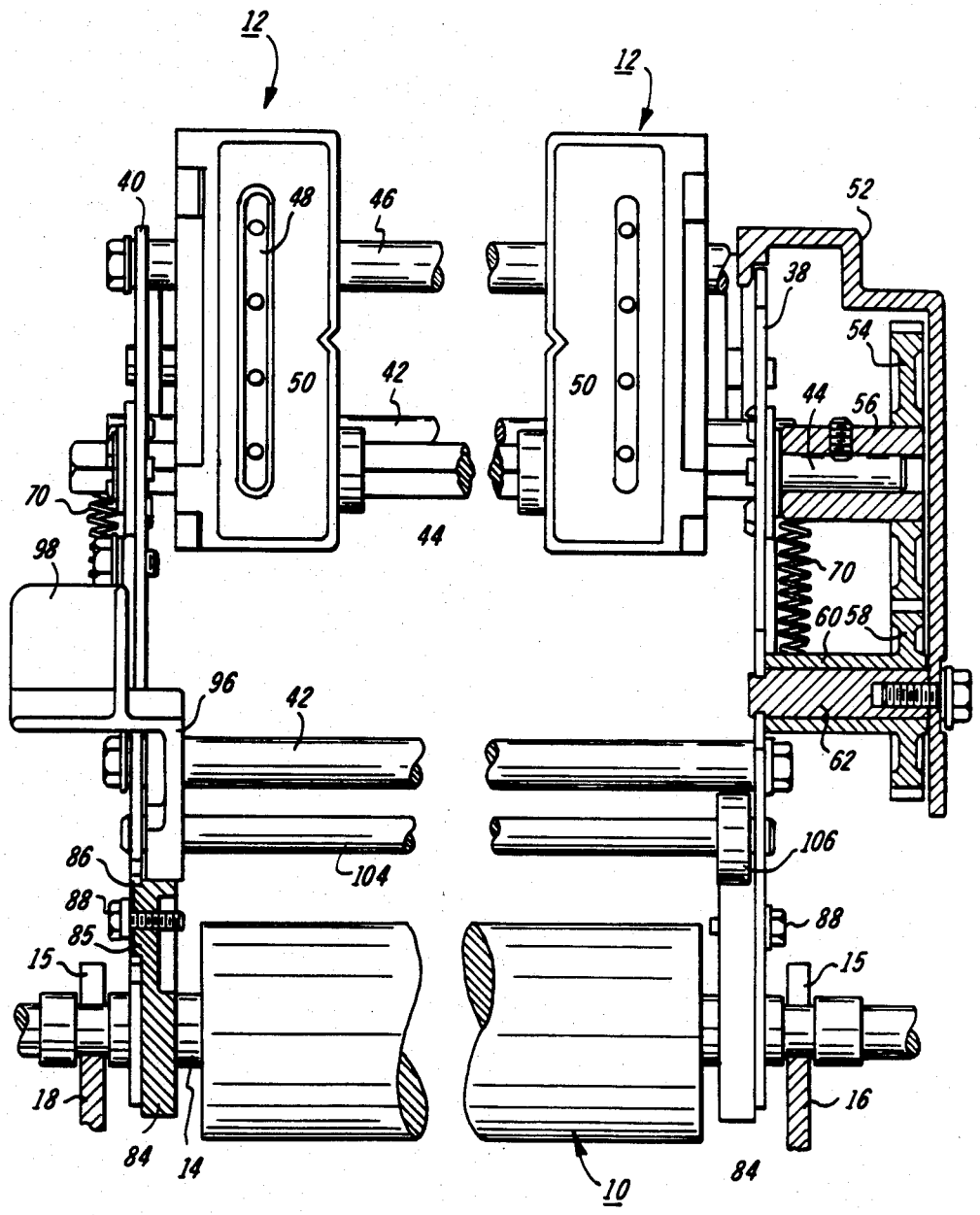
Figure 4:
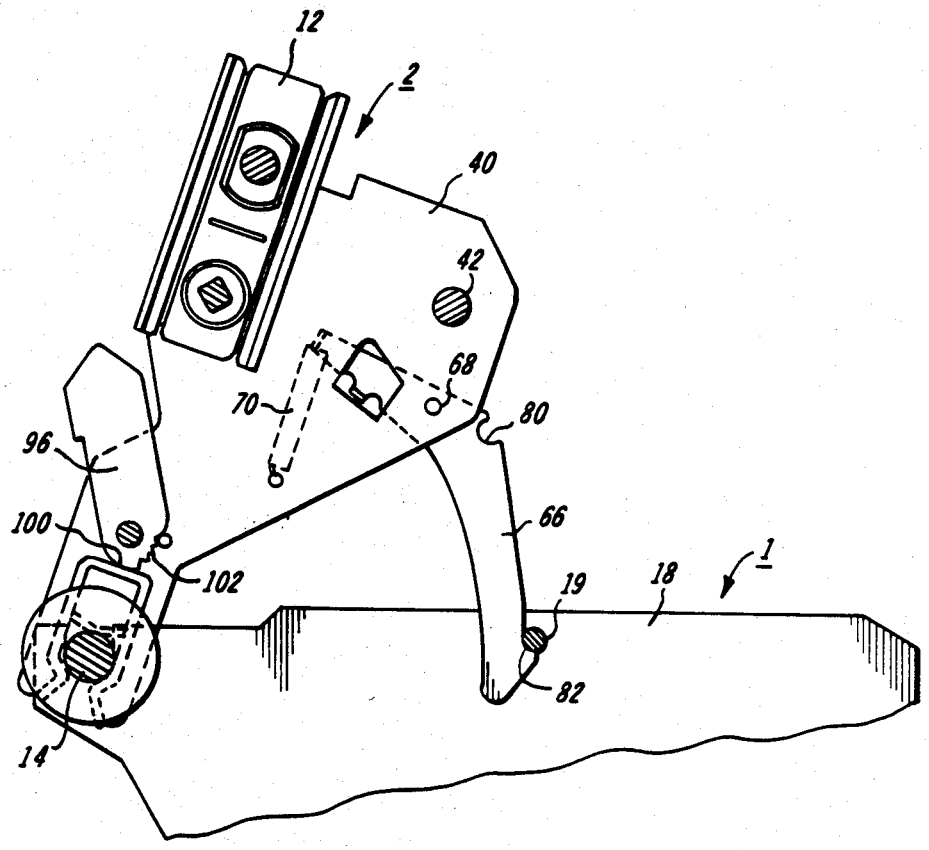
Figure 5:
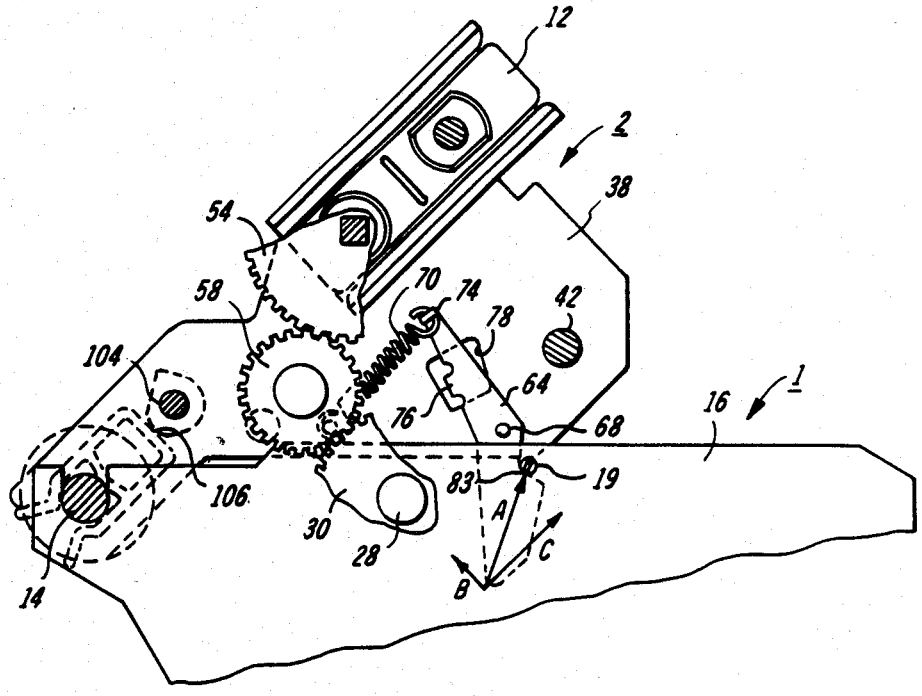
Figure 6:
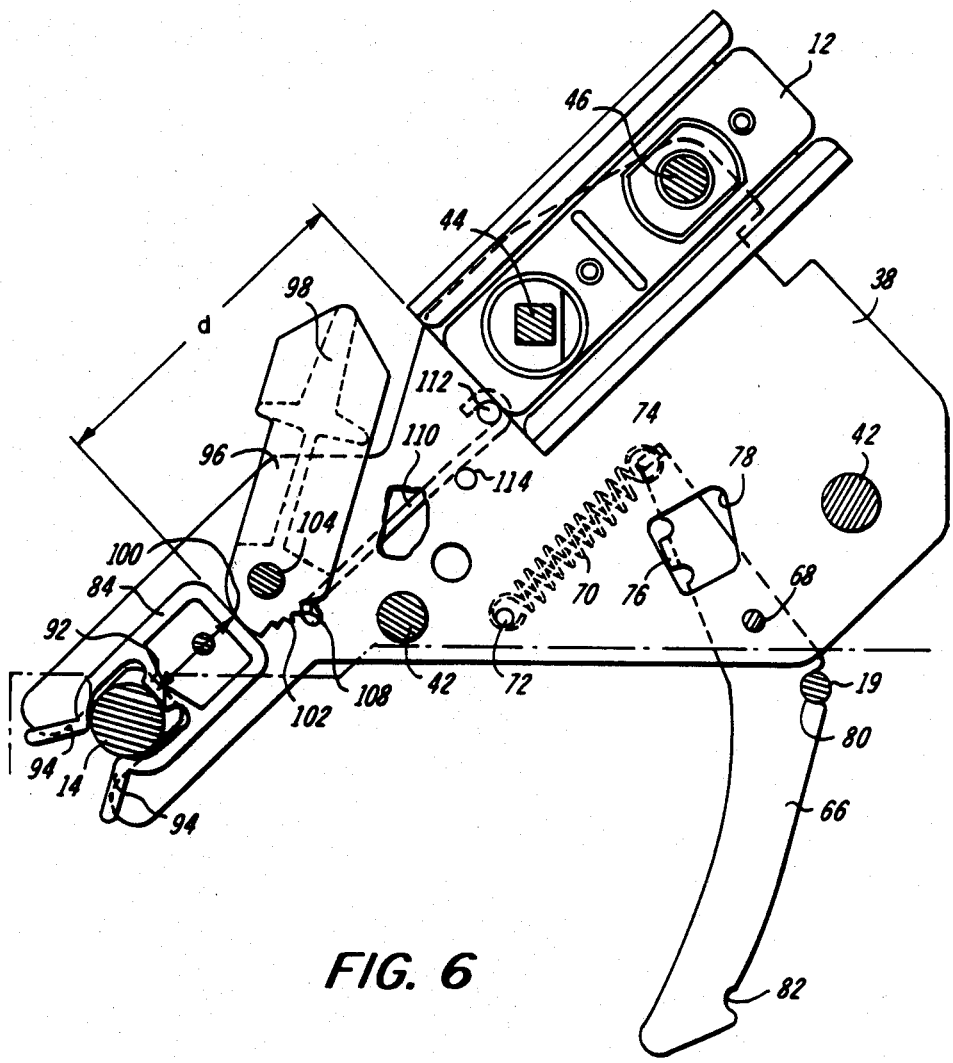

Further features and advantages of my invention will be apparent from the following, more particular, description when considered together with the accompanying drawings, wherein:

FIG. 1 is a schematic, partial side elevation view showing the paper path through the tractors and around the platen, FIG. 2 is a cutaway perspective view showing my improved tractor assembly mounted upon a printer, FIG. 3 is a top plan view showing the tractor assembly mounted upon a printer, FIG. 4 is a side elevation view showing the tractor assembly mounted upon a printer, in the paper loading position, FIG. 5 is a side elevation view showing the tractor assembly in its operative, paper feeding position upon a printer, and FIG. 6 is an enlarged side elevation view showing the details of the cam adjuster for varying the paper path length.

The paper path, indicated by phantom lines in FIG. 1 extends around the printer platen 10 from one side of the tractor 12 to the other. As different forms thicknesses are loaded, the nominal distance D will change. For example, a single part paper is about 0.004 inches thick while a six-part form with interleaved carbons could be 0.027 to 0.030 inches thick. If there is a transition from a taut six-part paper to single thickness paper, the latter will be slack. In order to obtain the proper tension on the paper and to remove slack therefrom, the operator should adjust the distance D. In the following discussion there will be described the structural elements which allow this adjustment to be made and the manner in which dynamic compensation is made for cyclic variations in the drive train.

The improved tractor assembly of my invention will now be described with reference to the more detailed drawings. In FIGS. 2 and 3 there is shown the upper portion of a printer 1 in which the platen roller 10, mounted on shaft 14, is journalled for rotation in cutouts 15 in printer side plates 16 and 18. Tractor positioning pins 19, firmly secured in plates 16 and 18, extend inwardly toward one another. A drive train 20, supported on side plate 16, includes a drive motor (not shown) to which is connected drive gear 22 connected to driver gear 24 by belt 26. A shaft 28 on which driver gear 24 is mounted is common to tractor drive gear 30 and platen drive gear 32. A belt 34 connects the platen drive gear 32 with platen gear 36 secured upon platen shaft 14.

In the absence of the tractor assembly the printer drives cut sheets in the known manner by means of the platen drive. When endless forms are to be introduced, the operator may mount the tractor assembly 2 upon the printer in a very simple procedure, to be described. The accessory includes two side plates 38 and 40 spaced apart and rigidly held in place by a number of rods 42. A pair of tractor modules 12 are slidably mounted upon a square drive rod 44 and an upper guide rod 46. Each tractor module includes an endless band 48 upon which are secured a number of drive pins 50 spaced from one another by the same distance as exists between the sprocket holes of the endless paper. A transmission enclosure 52 (shown in FIG. 3 but eliminated from FIG. 2 in the interest of clarity) covers tractor gear wheel 54 having a hub 56 secured upon an extension of the drive rod 44. The gear wheel 54 is in engagement with tractor drive pinion 58 having a hub 60 supported by stub shaft 62 secured in accessory side plate 38. During assembly, the stub shaft 62 is positioned relative to the drive rod 44 so that gear wheel 54 and drive pinion 58 are urged together to remove substantially all backlash therebetween.

A pair of pivoting mounting levers 64 and 66 are secured on the tractor side plates 38 and 40, respectively, for rotation about pivot pins 68, each securely mounted in its respective side plate. A spring 70 is carried by each tractor side plate with one end secured to a support pin 72 and the opposite end secured to a dog-leg portion 74 at the upper end of each mounting lever. In this manner, the upper end of each mounting lever is biased in a counterclockwise direction about its pivot pin 60 (as viewed from the right side of the accessory). In order to limit the range of movement of the levers, each is provided with another dog-leg portion 76 which moves within a limit stop opening 78 in the side plates.

Mounting lever 66 acts to lock the tractor assembly in two positions. A first locking detent 80 serves to fix the left side of the assembly in the operational position and a second locking detent 82, located at the lower end of the lever, serves to fix the assembly in an elevated, paper loading position. Each of the locking detents 80 and 82 receives positioning pin 19 of side plate 18. Mounting lever 64 serves a different function altogether. It includes a biasing surface 83 which contacts its respective positioning pin therealong and acts to allow the right side of the tractor assembly to "float" with respect to the printer side wall 16. The spring 70 has a rate which urges the tractor assembly and the printer together with sufficient force to maintain mating gears 30 and 58 positively engaged with no backlash therebetween. Thus, the gear train compensates for variations in the actual center distances and the mesh of the teeth between these two gears.

The tractor assembly 2 is mounted upon the platen shaft 14 by means of mounting clips 84 preferably made of a resilient, low friction, plastic material. Each clip has a shoulder 85 slidably positioned in a slot 86 in its respective side plate and secured by a fastener 88 so as to be confined for movement along a line extending from the centerline of the platen shaft 14 to the centerline of the tractor. A U-shaped opening 90 in each side plate is sized to accommodate the platen shaft in such a way that its opposed walls will contact the shaft but its root will not contact the shaft. Thus, load bearing contact, between the platen and the tractor assembly, is made solely by low friction bearing spacer 92 against the platen shaft 14, with snap fastening legs 94 capturing the shaft and urging it securely toward the bearing spacer. The opposed walls of the opening 90 will hold the shaft to insure lateral stability of the tractor assembly.

A paper tensioning lever 96 is positioned adjacent side plate 40. It has a handle portion 98 at one end and a cam surface section 100 and a ratchet section 102 at its other end and is secured for rotation about rod 104. The rod extends between side plates 38 and 40 and is mounted so as to rotate freely in the side plates and provide the axis of rotation for the cam surface section 100. A second cam 106, having a cam surface identical to the cam surface section 100, is secured to rod 104 adjacent side plate 38. In order to retain the tensioning lever in any of its adjusted rotary positions, a pawl 108, formed at the end of spring wire 110, is urged against the ratchet section 102. The spring wire is held in place and biased against the ratchet section by pins 112 and 114, secured in side wall 40.

Having described the structural elements of my improved tractor assembly device, I will now explain its improved operation as enabled by my unique design. Particular reference will be made to FIGS. 4, 5 and 6. When the operator desires to change from feeding individual sheets to feeding endless forms, a top cover will normally be removed and the tractor assembly 2 will be mounted upon the printer 1. First, the tractor assembly is held in a substantially vertical position with the mounting clips 84 atop the platen shaft 14. By exerting a slight downward force, the fastening legs 94 of the mounting clips are snapped over and around the platen shaft so that the bearing spacer 92 is urged against the shaft. Then, the assembly is tilted back until the second locking detent 82 on mounting lever 66 captures the positioning pin 19 on printer side plate 18, as illustrated in FIG. 4. In this orientation, the assembly is maintained in an elevated relationship to the platen during the loading of paper. Once the paper has been properly loaded, the operator pushes down on the tractor assembly to overcome the biasing force of the spring 70 (on tractor assembly side plate 40), for releasing the positioning pin 19 from the second locking detent and continues to push until the positioning pin is captured in first locking detent 80, as illustrated in FIG. 6, for placing the assembly in its operative position.

Simultaneous with the locking action being effected on the left side of the printer, the mounting lever 64 on the right side of the tractor assembly is snapped over positioning pin 19 so that the biasing surface 83 is urged thereagainst by the action of spring 70 (on tractor assembly side plate 38), thus drawing the tractor assembly down upon the printer. It should be noted that the right side of the tractor assembly is not statically located but rather "floats" relative to the fixed left side of the assembly. As the right spring 70 pulls the mounting lever 64, a force is exerted by the biasing surface 83 in the direction indicated by arrow A (FIG. 5). Force A has orthogonal component force B extending in a direction substantially parallel to the line extending between centers of gears 30 and 58, and orthogonal component force C extending substantially parallel to the line extending between the centers of tractors 12 and the platen 10. Force B insures that there will be no backlash in the gear train. Force C urges the bearing spacer 92 against the platen shaft 14. The spring rate is selected so that sufficient force is applied to eliminate backlash but not enough to overload the drive motor.

Once the tractor assembly is in its operative position, the operator may reposition the handle 98 of tensioning lever 96 to rotate the cam surface portion 100 for moving the tractors 12 in order to achieve the proper tension in the endless paper. The lever is maintained in the selected position by the wire pawl 108 seated in one of the detents of the ratchet section 102.

It can now be seen that I have provided an extremely inexpensive and simple device which performs two important functions required for accurate printing registration in bi-directional printers. First, it removes all slack from the paper path and second, it dynamically eliminates all backlash between the printer drive gear and the tractor assembly driven gear.

It should be understood that the present disclosure has been made only by way of example and that numerous changes in details of construction and the combination and arrangement of parts may be resorted to without departing from the true spirit and the scope of the invention as hereinafter claimed.

What is claimed is:

1. A transport assembly device for being mounted upon a printer for transporting an endless form image receptor to and from a printing mechanism, said printer including a pair of side walls, a platen mounted upon a support shaft journalled for rotation in said side walls, transport assembly positioning pins extending from each of said side walls and drive gear means supported by one of said side walls, said transport assembly being characterized by comprising:

a pair of side plates supported in opposed, spaced relationship to one another, a drive shaft supported by said side plates for rotation relative thereto, driven gear means supported upon one of said side plates and coupled to said drive shaft, image receptor driving means supported between said side plates and driven by said drive shaft, means for mounting said side plates upon said support shaft, said means for mounting being adjustable so as to move said driving means toward and away from said platen, adjustment means for varying the location of said means for mounting relative to said side plates, means for locating said transport assembly in an operative position on said printer, and means for biasing said transport assembly against said printer, so as to urge said driven gear means against said drive gear means when said transport assembly is in its operative position for eliminating substantially all backlash therebetween, and so as to urge said means for mounting against said support shaft and wherein said means for biasing comprises a pivotable lever mounted to said side plate supporting said driven gear, and a spring secured to said pivotable lever for urging a biasing surface on said lever against one of said transport assembly positioning pins, said biasing surface being disposed at an angle for both urging said driven gear means against said drive gears means and urging said means for mounting against said support shaft.

2. The transport assembly of claim 1 characterized in that said image receptor driving means comprises laterally spaced tractor mechanisms.

3. The transport assembly of claim 1 characterized in that said means for mounting comprises a spring clip portion for latching said transport assembly upon said support shaft and a bearing portion which is urged against said support shaft.

4. The transport assembly of claim 1 characterized in that said adjustment means comprises a lever supported for rotation adjacent at least one of said side plates, said lever including at one end a cam portion and a ratchet portion, said cam portion being held in contact with said means for mounting, and a pawl supported upon said at least one of said side plates for cooperating with said ratchet portion to retain said lever in a selected position.

5. The transport assembly of claim 1 characterized by further including means for locating said assembly in an inoperative, elevated, image receptor loading position.

6. The transport assembly of claim 5 characterized in that said means for locating said assembly in an inoperative position and said means for locating said assembly in an operative position comprise spaced detents on a pivotable lever mounted upon one of said side plates.

* * * * *